United States Patent [19]

Bader

[11] 4,423,810

[45] Jan. 3, 1984

[54] COVER FOR MULTIPLE UNIT CONTAINER PACKAGES

[75] Inventor: James S. Bader, Lakewood, Colo.

[73] Assignee: Adolph Coors Company, Golden, Colo.

[21] Appl. No.: 292,811

[22] Filed: Aug. 14, 1981

[51] Int. Cl.[3] ..... B65D 71/00

[52] U.S. Cl. ..... 206/158; 206/159; 206/161

[58] Field of Search ..... 206/159, 160, 161, 139, 206/141, 145–158

[56] References Cited

U.S. PATENT DOCUMENTS

| | | | |
|---|---|---|---|
| 3,233,730 | 2/1966 | Winters et al. | 206/159 |
| 3,314,713 | 4/1967 | Noel | 206/158 |
| 3,321,076 | 5/1967 | Poupitch | 206/159 |
| 3,434,592 | 3/1969 | Moore et al. | 206/159 |
| 3,612,266 | 10/1971 | Graser | 206/161 |
| 3,653,504 | 4/1972 | Saumsiegle | 206/161 |
| 3,727,752 | 4/1973 | Poupitch | 206/159 |
| 4,216,859 | 8/1980 | Bader et al. | 206/159 |
| 4,296,858 | 10/1981 | Platt | 206/139 |

FOREIGN PATENT DOCUMENTS

| | | | |
|---|---|---|---|
| 714401 | 7/1965 | Canada | 206/158 |

*Primary Examiner*—Joseph Man-Fu Moy
*Attorney, Agent, or Firm*—Bruce G. Klaas

[57] ABSTRACT

A cover for multiple unit container packages of containers secured by at least one clip device having a central opening wherein the cover includes a tab device extending through the clip opening and engaging clip bottom surfaces to hold the cover in place on the top of the multiple unit package.

14 Claims, 5 Drawing Figures

COVER FOR MULTIPLE UNIT CONTAINER PACKAGES

BACKGROUND AND SUMMARY

This invention relates to apparatus for and methods of providing an attachment for multiple unit packages of containers generally known as "six packs" or "eight packs" or "twelve packs" or the like. The attachment may be used as a protective cover and/or an advertising device.

The invention is useful in connection with multiple unit container packages which are held together by one or more clip devices of the type described in U.S. Pat. No. 4,216,859 of Bader, et al., the disclosure of which is incorporated herein by reference.

The following prior granted U.S. patents disclose various related cover and/or package concepts: Suffern, U.S. Pat. No. 4,191,290; Poupitch, U.S. Pat. No. 2,923,405; Poupitch, U.S. Pat. No. 2,936,070; Poupitch, U.S. Pat. No. 3,331,500; Poupitch, U.S. Pat. No. 3,628,823; Poupitch, U.S. Pat. No. 3,628,823; and, Arneson, U.S. Pat. No. 3,410,394.

In general, the method of the present invention comprises assembly of a multiple container unit by inserting and attaching one or more clips between and to the rims of four or six or eight or ten or twelve, etc. containers. Then a precut and prescored flat preassembly cover sheet of predetermined construction is placed on the end surfaces of the containers joined by the clips in predetermined alignment therewith. The sheet may have printed advertising materials on the upper surface and a coupon attached to the bottom surface. Then central portions of the flat cover sheet are retainably associated with portions of the clips. The sheet may be provided with edge panel portions which are retainably associated with side surface portions of the containers adjacent the joined end surfaces.

The flat cover sheet central portions are associated with portions of the clips by resiliently depressing integral tab portions into retaining engagement with the clip portions. The flat cover sheet edge panel portions are associated with side portions of the containers by resilient deflection into conforming engagement therewith and adhesively connecting adjacent ones of the edge portions.

In one embodiment, illustrating the use of the invention as a protective cover, the flat cover sheet comprises one piece of material, such as paper or plastic, having a central body portion with peripheral edge panels centrally connected thereto by cut and/or score lines to enable folding along the cut and score lines to an assembled position extending at substantially right angles relative to the central body portion. The edge panels along each side of the central body portion are separated from one another by slits adjacent the corners of the flat cover sheet to enable relative displacement therebetween. Slots are provided adjacent each corner to separate and space the edge panels from the central body portion. The slots are defined by a curved edge surface of the body portion, which has a radius of curvature approximately equal to the radius of curvature of the end portion of the container to be located in juxtaposition thereto, and a pair of intersecting straight edge panel portions aligned with the score lines. The flat pre-assembly cover sheet further comprises retaining tab means associated with the central body portion for movement from the plane of the flat cover sheet toward the clips and into resilient retaining engagement therewith. The retaining tab means are aligned with the openings in the clips whereby the multiple container unit may be carried by insertion of a person's thumb and fingers after assembly of the package. The retaining tab means is of generally T-shaped peripheral configuration with a stem portion integrally attached to the central body portion of the cover along a cut and score fold line and a laterally elongated flap portion integrally connected to the stem portion and severed from the central body portion by a cut line. The flap portion is provided with a pair of inclined score lines to provide a pair of resilient deflectable ear portions which, upon movement of the tab portion into the central circular opening of the clip, are locateable therebeneath and retainably engageable therewith. In other embodiments, the peripheral edge panels are not included and the configuration of the periphery of the cover sheet may be the same as or smaller than the periphery of the package of containers. In addition, the configuration of the periphery of the cover sheet may be other than essentially polygonal.

BRIEF DESCRIPTION OF DRAWING

Illustrative and presently preferred embodiments of the present invention are shown in the accompanying drawing in which.

DETAILED DESCRIPTION

Figure 1:
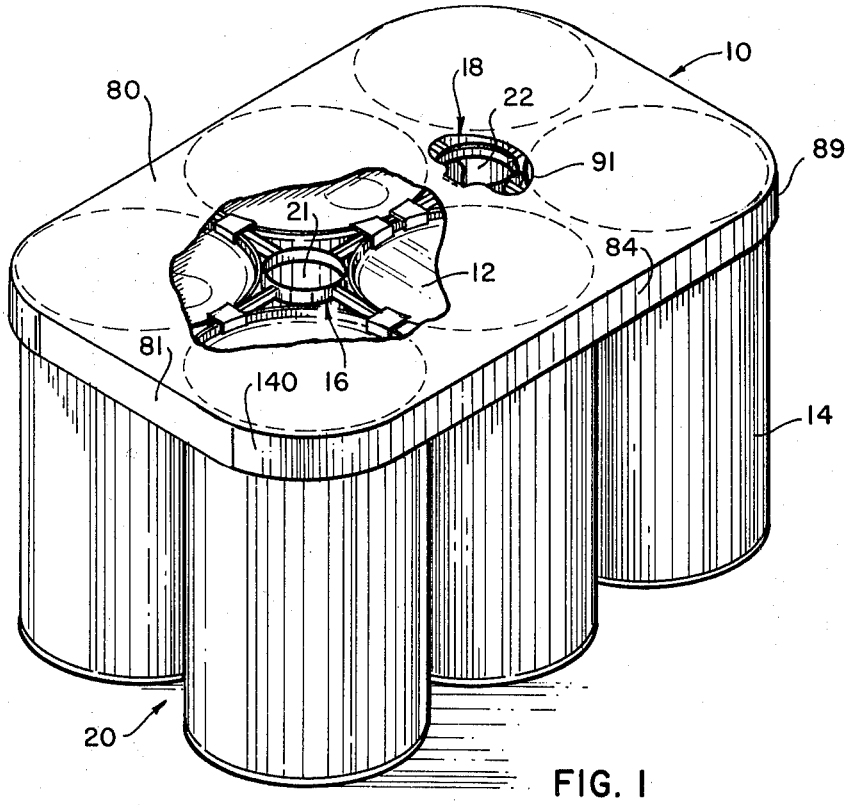
FIG. 1 is a schematic perspective view of a cover sheet member, with a portion broken away, after assembly and mounting on a multiple container package unit.

In general, the invention comprises a cover member 10 made of one piece of paperboard or plastic material which is detachably mounted over the opening end surfaces 12 of a plurality of can-type containers 14 connected by one or more clip members 16, 18 to form a multiple container package unit 20 with finger openings 21, 22 to enable hand carrying of the package unit.

Figure 3:
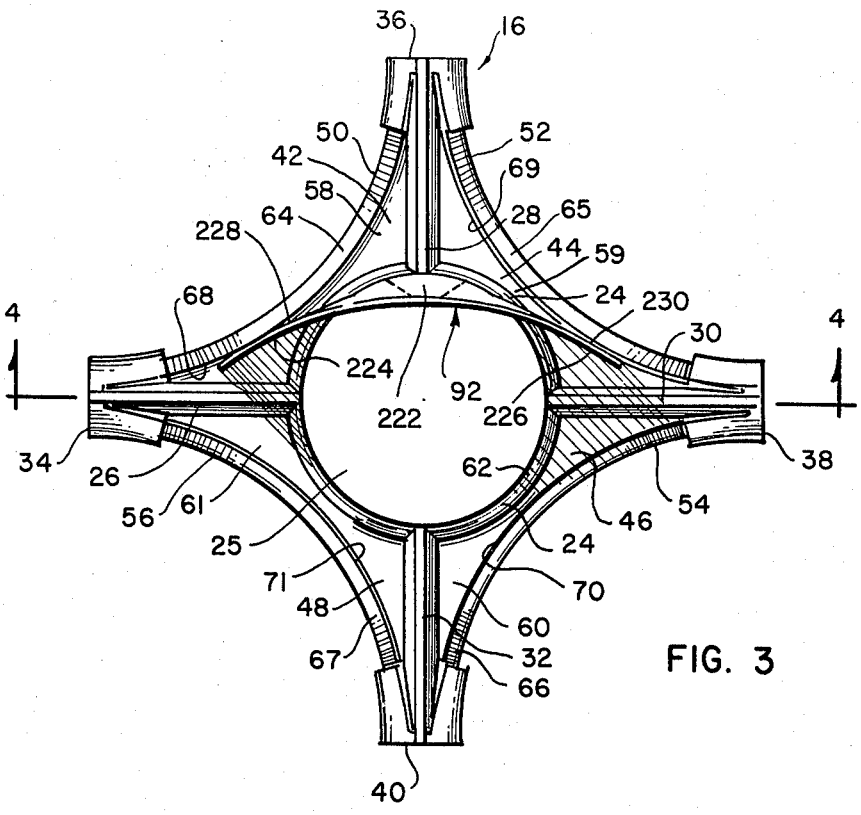
FIG. 3 is an enlarged bottom view of the clip and associated retaining tab means of FIG. 1.
Figure 4:
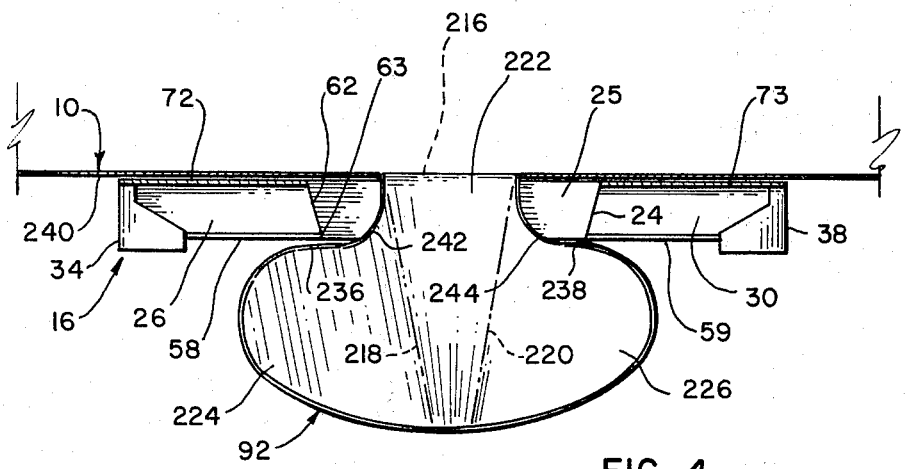
FIG. 4 is a cross-sectional view of the clip and retaining tab means taken along line 4—4 in FIG. 3.

Each of the clip members 16, 18 are made of one piece of plastic material comprising a downwardly inwardly tapered circular inner rim portion 24 defining a finger opening 25, FIG. 3; four equally spaced radially outwardly extending hollow rib portions 26, 28, 30, 32 terminating in enlarged clip portions 34, 36, 38 40 which are releasably connectable to the rims of the container ends; and flange portions 42, 44, 46, 48 extending between the rib portions with arcuate concave outer side surfaces 50, 52, 54, 56 adapted to abuttingly receive outer surface portions of the cylindrical side walls of the body portions of the containers. The flange portions 42, 44, 46, 48 have flat coplanar bottom surfaces 58, 59, 60, 61 which intersect the downwardly inwardly tapered inner surface 62 of rim portion 24 along a circular edge 63. Arcuate ribs 64, 65, 66, 67 extend downwardly from the outermost portions of flanges 42, 44, 46, 48 and provide arcuate inner surfaces 68, 69, 70, 71 which intersect bottom surfaces 58, 59, 60, 61. The upper surfaces 72, 73 of each of the rib portions 26, 28, 30, 32 and associated clip portions 34, 36, 38, 40 are coplanar as illustrated in FIG. 4. As shown in FIG. 1, the clip members are mounted in the space defined by and located between groups of four containers arranged in closely spaced relationship with lower side surface portions of the containers in abuttingly engageable relationship to form a multiple container package unit. Other details of construction and usage of the clip members are described in the afore-identified U.S. Pat. No. 4,216,859.

The cover member 10 comprises a central body portion 80 having a peripheral configuration corresponding to the peripheral configuration of the multiple container package unit so as to fully cover the opening end surfaces of each container with a solid unperforated portion of the cover member. Transversely extending side panel portions 81, 82, 83, 84 are integrally connected to the peripheral portions of the central body portion 80 along score and/or cut fold lines 85, 86, 87, 88; and are connected to form a rim means 89 extending completely around the periphery of the multiple container package unit in closely spaced substantially abutting relationship with surface portions of the cylindrical side walls of each of the containers closely adjacent the opening end portions thereof. Finger receiving openings 90, 91 are provided in the central body portion opposite to and aligned with each of the clip finger openings 21, 22 when integral tab-type retaining means 92, 94 in the central body portion 80 are depressed into the clip finger openings and detachably connected to each of the clip members 16, 18.

Figure 2:
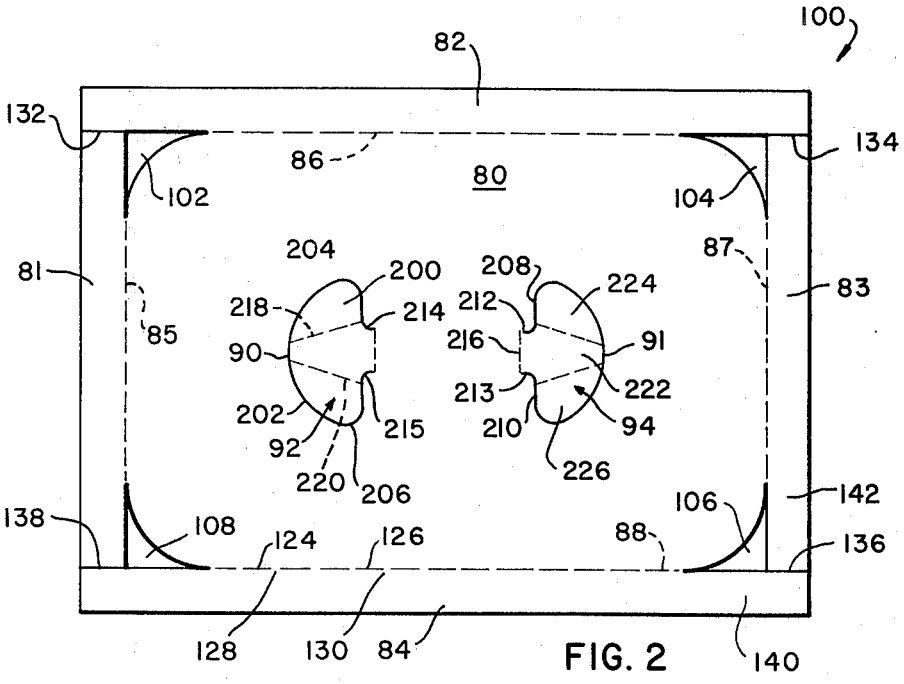
FIG. 2 is a top plan view of a flat preassembly cover sheet prior to assembly and mounting as shown in FIG. 1.

The pre-assembly form and construction of cover member 10 prior to being formed about and attached to the multiple container package unit, as shown in FIG. 2, comprises a flat one piece rectangular sheet of material 100 which has been stamp cut, perforated and scored from a larger continuous sheet of material by conventional package manufacturing apparatus and methods. The central body portion 80 is defined by corner cut-out openings 102, 104, 106, 108 and fold lines 85, 86, 87, 88. Each cut-out corner opening comprises transversely extending intersecting straight line edge surfaces 118, 120, which intersect opposite ends of a convexly curved cut line 122, having a radius approximately equal to the outer peripheral radius of the opening end portion of the container, and are aligned with the fold lines 85, 86, 87, 88. In the embodiment of FIG. 2, each fold line comprises regularly spaced slits 124, 126 separated by regularly spaced score lines 128, 130 to define opposite parallel pairs of relatively long and short length elongated rectangular side panel portions 82, 84 and 81, 83, respectively, which are separated from one another by corner slits 132, 134 and 136, 138 aligned with fold lines 86 and 88, respectively. The construction and arrangement is such that each corner comprises a relatively long length tab portion 140 and a relatively short length tab portion 142 adapted to be wrapped into overlapping relationship about the cylindrical side wall of the corner container and fixedly connected by use of layers of adhesive material (not shown) applied to one or the other of the tab portions prior to the wrapping. If desired, the edge panels 81, 82, 83, 84 may be eliminated so that the protective cover has a peripheral configuration the same as body portion 80.

Referring now to FIGS. 2–5, each of the integral tab-type retaining means 92, 94 is shown to comprise a mushroom shaped tab portion 200 defined by a relatively large radius cut line 202; a pair of opposite relatively small radius cut lines 204, 206; a pair of opposite aligned relatively long length straight cut lines 208, 210; a pair of parallel spaced relatively short length cut lines 212, 213 connected to lines 208, 210 by curved cut lines 214, 215; and a scored fold line 216 at the integral connection between the tab portion 200 and the body portion 80. A pair of outward inwardly inclined scored and cut lines 218, 220 divide the tab portion 200 into a central portion 222 and ear portions 224, 226. After the sheet 100 is placed over the multiple container package unit with tab means 92, 94 aligned with clip openings 21, 22, the tab portions 200 are forced downwardly through openings 21, 22 by applying force to the upper surface of central portion 222 by a suitable tool such as a punch (not shown) having a cross-sectional shape enabling movement into the clip openings which causes the ear portions 224, 226 to be resiliently folded toward one another about fold lines 218, 220, a sufficient distance to enable passage through openings 21, 22. As shown in FIGS. 3 & 4, central portion 222 generally conforms to and is located adjacent the inclined conical surface 62 of rim 24. After the ear portions 224, 226 pass through openings 21, 22, they resiliently outwardly expand about fold lines 218, 220, which provide resilient hinge means, and may engage curved surfaces 68, 69, of rim portions 64, 65 at 228, 230. In addition, flat edge upper ear surfaces 236, 238, defined by cut lines 208, 210, abuttingly engage lower surfaces 58, 59 of clip flange portions 42, 44 to detachably hold the cover 10 on the multiple container package unit until and unless forcibly removed therefrom by the consumer.

The bottom surface 240 of central body portion 80 abuts the coplanar flat upper surfaces 72, 73 of the clips. The curved upper tab edges 242, 244 (defined by cut lines 214, 215) extend across and beneath the circular bottom edge between bottom surfaces 58, 59 and opening side surface 62. The distance between hinge line 216 and surfaces 236, 238 is approximately equal to the distance between clip top surfaces 72, 73 and clip bottom surfaces 58, 59 so as to establish an interference fit therebetween in the assembled position. As shown in FIG. 1, the openings 90, 91, defined by tab portions 200, are slightly larger than the clip openings 21, 22 so as to enable insertion of a finger therethrough to grip the clip with the main body portion of the cover extending over the entire upper opening and surface of the containers adjacent thereto. The upper surface of body portion 80 may be provided with suitable advertising and promotional decorations and information. A coupon may be attached to the bottom surface of body portion 80 as illustrated in FIG. 5 so as to be accessible to the consumer only after the package has been purchased and the cover has been removed.

Figure 5:
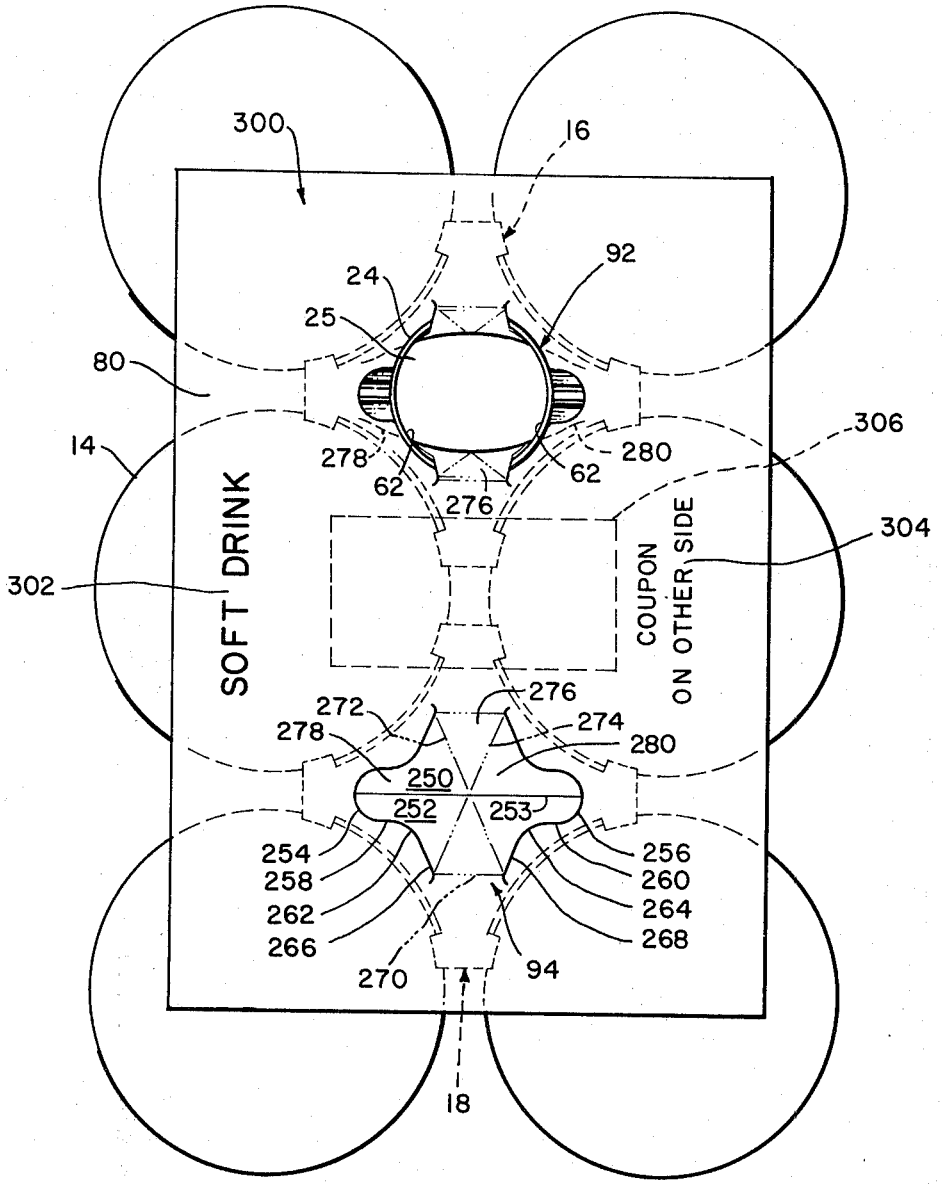
FIG. 5 is a top view of another embodiment of a flat cover sheet member having a retaining tab means of a different configuration.

Referring now to FIG. 5, an alternative and presently preferred embodiment of the tab means 92, 94 is shown to comprise a pair of oppositely positioned tab portions 250, 252 of generally truncated bell-shape peripheral configuration separated by a central cut line 253. Each tab portion 250, 252 is defined by opposite laterally outermost curved cut lines 254, 256, laterally outwardly inclined straight cut lines 258, 260, curved cut lines 262, 264, laterally outwardly inclined straight cut lines 266, 268 and a scored fold line 270 providing an integral hinge means connecting the tab portion to central body portion 80. A pair of outwardly inwardly inclined converging score fold lines 272, 274 divide the tab portions 250, 252 into a central portion 276 and ear portions 278,

280. After assembly as hereinbefore described, and as illustrated in the upper portion of FIG. 5, the outermost parts of tab ear portions 278, 280 of both tab portions 250, 252 are located beneath the associated clips 16, 18 in abutting engagement with clip flange bottom surfaces 58, 59, 60, 61 and may engage clip rib side surfaces 68, 69, 70, 71 as previously described. Again, central tab portions 276 extend downwardly through clip openings 25 in juxtaposition to downwardly inwardly inclined conical side surfaces 62 of the clip openings.

As shown in FIG. 5, the invention may be used to provide an advertising and promotion cover sheet 300 which is of smaller size than the upper peripheral surface of the container package and not intended to be used to protect the upper opening end surfaces of the containers. While the peripheral configuration of cover sheet 300 is shown to be rectangular, it is to be understood that it may have any peripheral configuration such as that of a basketball or football with corresponding artwork to be used for a special promotion of an event, a holiday or the like. Suitable advertising and promotional printed matter 302, 304 may be provided on the upper surface and a coupon 306 may be attached to the bottom surface between tab means 92, 94.

In order to assemble the multiple container package unit of FIGS. 1 and 5, individual containers are arranged in groups of four or six or eight, etc. Clip members are then inserted into the cavities between the containers and attached to the rim portions of the opening end portions of the containers. Then a precut and scored flat sheet member 100 is placed over the opening end portions of the containers with the periphery of the central body portion of member 100 aligned with the periphery of the multiple container unit. The central body portion of member 100 is supported on the rim portions of the containers and tab means 92, 94 are aligned with clip finger openings 21, 22. Panel portions 81, 82, 83, 84 extend outwardly beyond the periphery of the multiple container unit with cut and score lines 85, 86, 87, 88 located along the periphery thereof. The tab means 92, 94 are then displaced downwardly into retaining engagement with the clip members as hereinbefore described. An adhesive material is applied to the bottom surfaces of panel end portions 140. Each panel portions 81, 83 and side panel portions 82, 84 are folded downwardly about fold lines 85, 87, and 86, 88, respectively, into engagement with the outermost surfaces of the body portions of the adjacent containers. Panel end portions 142 and 140 are then wrapped about the outermost side surfaces of the corner containers with shorter length end portions 142 first engaging the container side surfaces and longer length end portions 140 then being wrapped about the container side surfaces and over end portions 142. Adhesive material fixedly connects the end portions 140 and 142 to secure the panel portions beneath the chimes of the opening end of the container. In this manner, the cover 10 is formed on and detachably secured to the multiple container unit solely by integral tab means 92, 94 connected only to the clip members 16, 18 which provide sufficient strength to enable the cover member 10 to be retained on the multiple container unit throughout subsequent handling and storage during distribution to the consumer while enabling the cover to be easily removed by the consumer. The cover member serves to protect the opening end portions of the container from possible contamination and also enables the use of pre-printed advertising and identification indicia on the upper surface of the cover.

It is intended that the claims appended hereto be construed to cover alternative embodiments of the invention except insofar as limited by the prior art.

What is claimed is:

1. An apparatus for securing and covering a group of cans comprising:

molded clip means disposed in at least one intersticial opening between end portions of a plurality of cans for securing said plurality of cans in a group, said molded clip means hving flange portions and chime engaging means defining curved surface portions which are coupled to said flange portions to form rim portions, said curved surface portions and said flange portions defining a central opening in said clip means having a size and shape suitable for insertion of a finger;

cover means for providing a covering over said end portions of said group of cans comprising:

main body means for covering at least part of said end portions of said group of cans;

locking tab means formed in said main body means by cut-lines and disposed to align with said molded clip means for integrally locking said cover means to said clip means and holding said cover means in engagement with said clip means;

fold line means for allowing said locking tab means to be displaced from said main body means at said cut-lines and inserted in said central opening of said clip means;

resilient hinge means disposed on said locking tab means for providing a resilient fold line between a central portion and ear portions of said locking tab means which causes said ear portions to fold relative to said central portion about said resilient fold line during insertion of said locking tab means in said central opening of said molded clip means and to resiliently outwardly expand to engage said curved surface portions defined by said chime engaging means and abut against said flange portions such that forces produced between said molded clip means and said cover means causes said ear portions to become seated in and further engage said rim portions to hold said ear portions in an expanded position in interlocking relationship with said clip means and prevent removal of said cover means from said molded clip means.

2. The invention of claim 1 further comprising:

side panel means connected to said main body means by fold lines formed between said main body means and said side panels means for forming a peripheral edge of said cover means which is coextensive with side portions of said group of cans.

3. The invention as defined in claim 1 wherein said locking tab means comprises (comprising):

a pair of opposed flap portions severed in part from said main body portion so that said flap portions fold together around inner portions of said clip means to provide finger protection.

4. The invention as defined in claim 1 wherein said locking tab means has a generally T-shape peripheral configuration.

5. The invention as defined in claim 4 and wherein said locking tab means has a generally mushroom peripheral configuration.

6. The invention as defined in claim 4 and wherein said locking tab means further comprises a single tab portion.

7. The invention as defined in claim 1 further comprising:

a removable coupon means located on the bottom surface of said cover means for dispensing to a customer after purchase of the group of filled containers and removal of said cover means.

8. The invention as defined in claim 7 and wherein:

said removable coupon means being located adjacent said locking tab means for preventing access thereto prior to removal of the cover.

9. The invention as defined in claim 22 wherein there are at least two locking tab means and further comprising:

a removable coupon means located on the bottom surface of said cover means between said locking tab means for preventing access thereto subsequent to attachment to the group of filled containers and prior to removal of said cover means from said group.

10. The invention as defined in claim 9 further comprising:

advertising and promotional means on the upper surface of said cover means for directing attention to said coupon means.

11. A method of attaching a cover on a group of containers secured together by at least one clip device having a central opening therein comprising the steps of:

forming a group of at least four containers in a square configuration providing a central space therebetween;

inserting the clip device into the central opening and connecting the clip device to rim portions of each of the containers to maintain the containers in the square configuration;

placing a flat pre-cut pre-scored cover member having a tab retaining means integrally formed therein on top of the containers with the tab relaining means aligned with the central opening in the clip device; and connecting the tab retaining means to the clip device by applying downward force against the tab retaining means and forcing the tab retaining means downwardly into and through the central opening in the clip device and locating end portions of the tab retaining means beneath the clip device adjacent the central opening, the flat pre-cut, prescored, cover member including side panel portions and further comprising:

forcing the side panel portions downwardly around the outer periphery of the group of containers; and adhesively securing adjacent end portions of the side panel portions to form a continuous downwardly depending rim extending completely around the outer periphery of the group of containers.

12. The method as defined in claim 11 and further comprising:

providing a removable coupon on the bottom surface of the cover member prior to attaching the cover member to the group of containers.

13. The method as defined in claim 12 and further comprising:

locating the coupon adjacent the tab retaining means to prevent removal of the coupon prior to removal of the cover member from the group of containers.

14. The method as defined in claim 13 and comprising:

printing information relating to the coupon on the upper surface of the cover member.

* * * * *